US007371106B2

(12) United States Patent
Nad

(10) Patent No.: US 7,371,106 B2
(45) Date of Patent: May 13, 2008

(54) STRAIN-RELIEF DEVICE FOR A PLUG-IN CONNECTION IN COMMUNICATIONS AND DATA SYSTEMS

(75) Inventor: Ferenc Nad, Berlin (DE)

(73) Assignee: ADC GmbH, Berlin (DE)

( * ) Notice: Subject to any disclaimer, the term of this patent is extended or adjusted under 35 U.S.C. 154(b) by 0 days.

(21) Appl. No.: 11/827,809

(22) Filed: Jul. 13, 2007

(65) Prior Publication Data

US 2007/0259563 A1 Nov. 8, 2007

Related U.S. Application Data

(63) Continuation of application No. 11/540,431, filed on Sep. 29, 2006, now Pat. No. 7,267,572, which is a continuation of application No. 10/490,156, filed as application No. PCT/EP02/09023 on Aug. 12, 2002, now Pat. No. 7,114,987.

(30) Foreign Application Priority Data

Sep. 19, 2001 (DE) ..... 101 46 119

(51) Int. Cl.
*H01R 13/58* (2006.01)

(52) U.S. Cl. ..... 439/470; 439/449

(58) Field of Classification Search ..... 439/470, 439/471, 472, 449, 455, 459, 463, 133
See application file for complete search history.

(56) References Cited

U.S. PATENT DOCUMENTS 4,195,899 A 4/1980 Radloff et al. ..... 439/468
4,280,746 A * 7/1981 Ignatowicz ..... 439/470
4,516,822 A 5/1985 Wolfel ..... 439/468
5,372,513 A 12/1994 Rodrigues et al. ..... 439/98
5,445,538 A 8/1995 Rodrigues et al. ..... 439/460
5,839,911 A * 11/1998 Dinkel ..... 439/470
6,077,122 A 6/2000 Elkhatib et al. ..... 439/608
6,783,386 B2 8/2004 Clement ..... 439/467
6,953,362 B2 10/2005 Mossner et al. ..... 439/395

FOREIGN PATENT DOCUMENTS

DE 2 023 168 12/1970

(Continued)

OTHER PUBLICATIONS

International Search Report, 3 pages.
Delphion English Abstract for EP 0944132B1 (which is in the same family as DE 198 11 476).
Delphion English Abstract for EP 0447834B1 (which is in the family as DE 40 09 297).

*Primary Examiner*—Hae Moon Hyeon
(74) *Attorney, Agent, or Firm*—Merchant & Gould P.C.

(57) ABSTRACT

A strain relief device includes a telecommunications connector, a base member, a latching member, and a closure member. The telecommunications connector includes a housing at which the telecommunications cable can be terminated. The base member includes a body defining a hollow interior configured to receive the housing of the telecommunications connector. The latching member includes substantially rigid first and second limbs. The closure member includes substantially flexible first and second limbs extending from a support element that is configured to cooperate with a central region of the latching member to arrest the telecommunications cable. The first and second limbs of the closure member are configured to couple to the first and second limbs of the latching member.

20 Claims, 3 Drawing Sheets

FOREIGN PATENT DOCUMENTS

| | | |
|---|---|---|
| DE | 28 39 455 | 3/1979 |
| DE | 40 09 297 | 9/1991 |
| DE | 198 11 476 | 6/1999 |
| DE | 100 51 097 | 3/2002 |
| EP | 0944132 | 9/1999 |
| GB | 2 313 241 | 11/1997 |

* cited by examiner

STRAIN-RELIEF DEVICE FOR A PLUG-IN CONNECTION IN COMMUNICATIONS AND DATA SYSTEMS

CROSS-REFERENCE TO RELATED APPLICATIONS

This application is a continuation of U.S. Ser. No. 11/540,431, filed Sep. 29, 2006, now U.S. Pat. No. 7,267,572, issued Sep. 11, 2007, which is a continuation of U.S. application Ser. No. 10/490,156, filed Sep. 13, 2004, now U.S. Pat. No. 7,114,987, issued on Oct. 3, 2006, which is the National Stage of International Application No. PCT/EP02/09023 filed Aug. 12, 2002, which claims priority to German Application No. 101 46 119.4 filed Sep. 19, 2001, and which applications are incorporated herein by reference.

FIELD OF THE INVENTION

The invention relates to a strain relief device for a plug connector for communications and data technology.

BACKGROUND

Strain relief devices for cables for communications and data technology have been known in widely differing embodiments for a long time.

DE 40 09 297 C2 discloses an apparatus for attaching at least one cable to the racks or housings of telecommunications devices, having at least two toothed rods which are arranged on the rack part, in which case at least one cable is inserted between the toothed rods and can be secured by means of a spring element which can be clamped between the toothed rods.

DE 198 11 476 C1 discloses a cable clamp for making contact with the shield of cables when they are being fixed on a contact plate, comprising a web and two outer limbs which are connected to this web and are provided with cut-free lugs as holding elements for fixing the cable clamp on the contact plate, with the web being in the shape of a circular arc pointing outward in order to make contact with the cable shield, and being provided with web strips on the edges, pointing inward, for pressing into the cable shield, with the circular arc of the web being arranged symmetrically with respect to the cross section of the cable clamp, being matched to the external circumference of the cable to be connected, and, in terms of cross section, extending over only a portion of the length of the web.

The known strain relief devices have the disadvantage that the cable conductors are not aligned in a precisely defined manner with respect to the contacts of a plug connector which is to be connected to the cable. Particularly for very high transmission frequencies, this results in very large tolerances for crosstalk between adjacent conductor pairs and contact pairs.

DE 100 51 097, which has not yet been published, discloses a strain relief device for a plug connector for communications and data technology. The strain relief device in this case comprises an essentially U-shaped base part for holding at least part of the plug connector and of a cable which can be connected to the plug connector, with the base part being formed with the first latching means, and closure means, with the closure means being formed with second latching means, which form a latching connection with the first latching means on the base part. The base part is formed, on the lower face of the limbs, with guides which point inward, run parallel, and run at right angles to a rear wall of the base part. In the upper region, on the inside of the limbs, the base part is formed with in each case one obliquely running guide edge. The obliquely running guide edges are in this case designed to be complimentary to the guide edge of a cable manager. When the base part is put onto the cable manager and a plug connector housing, the cable manager is moved in the direction of the plug connector housing, and latches with it. During this process, the cable conductors make contact with the electrical contacts in the plug connector housing. Furthermore, the base part has two jaw parts which can be bent together and are articulated in a sprung manner on a base which is arranged on the upper face of the guide edges. The jaw parts are in the form of steps on the sides. Four openings, in the form of elongated holes, are arranged on each of the two sides on the upper face of the base. In the internal region, the two jaw parts are formed with pyramid-like structures. A spring, which acts as a locking means, can then be inserted into the openings, and a rigid closure element can be latched on. The essentially U-shaped closure element is for this purpose formed on the insides with latching troughs, which latch in on the legs of the spring. The known strain relief device has the disadvantage that its design is mechanically relatively complex owing to the moving jaw parts, which means that it must be manufactured from plastic.

SUMMARY

The invention is thus based on the technical problem of providing a strain relief device for a plug connector for communications and data technology, which, while having a simpler mechanical design, allows a defined force fit and defined alignment of the cable and plug connector.

For this purpose, the strain relief device has a base part for holding at least part of the plug connector and a cable which can be connected to the plug connector, with the base part being designed with first latching means, and closure means, with the closure means being designed with second latching means which form a latching connection with the first latching means on the base part, in which the closure means are in the form of a spring comprising two limbs which can be pushed along a guide onto the base part, with the base part being designed with at least one support point for the spring, and the spring being designed such that an opposing force, which is produced by the cable moves the second latching means, which are arranged on the limbs, toward the first latching means on the base part. There is thus no need for any sprung elements on the base part, so that the base part need not necessarily be produced from plastic but, for example, can also be produced as a die casting which, apart from increased strength, also has considerable cost advantages.

In one preferred embodiment, the spring is essentially W-shaped.

In one preferred embodiment, the spring is designed with a concave indentation in the middle, so that the spring can rest against the cable circumference.

The latching means of the spring are preferably in the form of latching hooks, which are preferably formed by a region cut free from the limbs of the spring.

In one preferred embodiment, bends are arranged at the free ends of the limbs of the spring, in order to make it easier to detach the spring from the base part when required.

In one preferred embodiment, the base part is designed with a moving head part on which the first latching means are arranged. This allows cables of different diameter to be fixed such that they are centered, so that the cable conductors are always secured in a defined position with respect to the plug connector contacts.

In a further preferred embodiment, the head part can be latched as a separate component, in a captive manner, on top of the base part. Designing it as a separate component simplifies manufacture, since there is no need to manufacture any moving parts while, on the other hand, the captive attachment makes it possible to handle the base part and the head part as a single component during use.

The component is preferably designed with an incline which runs upward inward, with the base part having a depression behind the incline. The head part then has a latching tab which can be pushed over the incline and then slides into the depression in a captive manner.

The head part is preferably designed to be completely symmetrical on the upper face and lower face.

The strain relief device can at the same time also be used to make contact with a cable shield. In this case, the base part is preferably structured on the inside, in order to improve the contact quality. This structuring may, for example, be pyramid-shaped.

In order to improve the contact quality further, a spring may also be formed with beads in the region of the concave indentation.

BRIEF DESCRIPTION OF THE DRAWINGS

The invention will be explained in more detail in the following text using a preferred exemplary embodiment. In the Figures.

DETAILED DESCRIPTION

Figure 1:
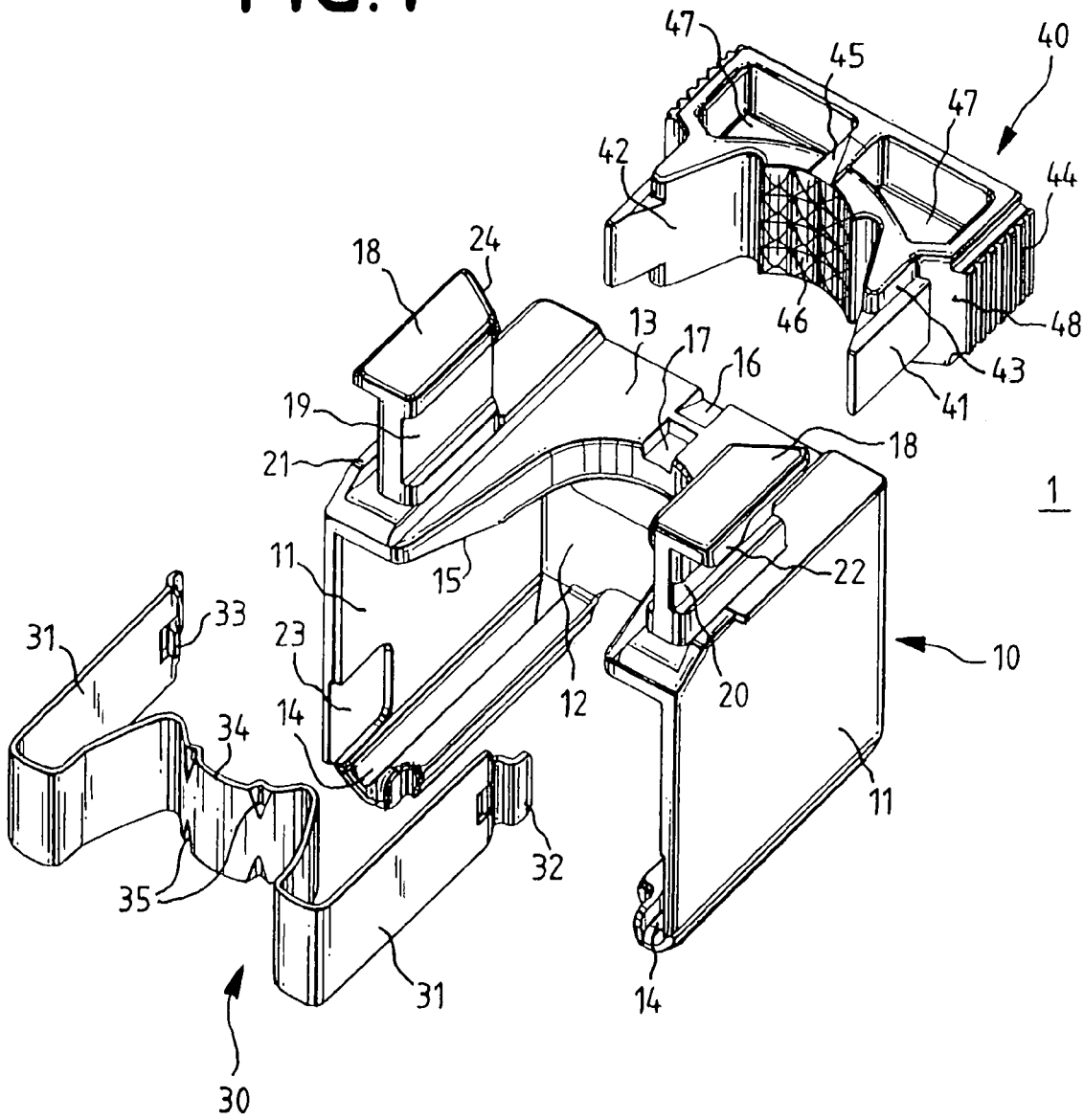
FIG. 1 shows a perspective exploded illustration of a strain relief device for a plug connector.

The strain relief device 1 has a base part 10, closure means 30 and a head part (i.e., latching member) 40. The base part 10 has two side walls 11, a rear wall 12 and an upper part 13. Guide edges 14 are arranged on the lower face of the side walls 111 and are at right angles to the rear wall 12. Guide edges 15, which run obliquely toward the rear, run on the upper face of the side walls 11 and on the lower face of the upper part 13. In the front region, the upper part 13 has a rounded cutout for holding a cable, which is not shown. On the side facing the rear wall 12, the upper part 13 has an incline 16 which runs inward and upward, and behind which a depression 17 is located. Two guide elements 18 are arranged in the front, side region of the upper part 13. Each guide element 18 firstly forms a guide 19 on the inside, and a guide 20 on the outside. In the region of the guide 20, the side wall 11 is raised somewhat above the upper part 13 in the front region, and forms a first support point 21. Furthermore, in the front region of the guide 20, the guide element 18 has an angle 22, which points downward and forms a second support point. In addition, the side walls 11 have indentations 23 on the insides.

The closure means 30 are essentially in the form of a W-shaped spring with two limbs 31. Angles 32 which point outward are arranged on the free ends of the limbs 31. The limbs 31 are each formed with a latching hook 33 which points inward. The closure means 30 include a central support element 34 configured to about cable 51, The central support element 34 of the W-shaped spring forms a concave bulge. Four beads 35 are introduced into the spring in the region of the concave bulge.

The head part 40 is essentially U-shaped. The free limbs are in this case formed as a smooth guide edge 41 on the outside in the front region, and as an incline 42, which runs outward, on the inside. In the front region, the limb is stepped and is designed to be set-back, thus forming a further guide surface 43. In the rear region, the limbs are formed with ribs 44 on the outside. There is in each case a latching tab 45, which runs obliquely upward toward the rear, centrally on the upper face and lower face of the head part 40. Pyramid-like structures 46 are arranged in the inner, central region of the head part 40. Furthermore, material-saving cutouts 47 are provided in the rear region of the head part 40. The transition from the guide edge 41 to the outside with the ribs 44 forms a stop surface 48. The stop surface 48 is preferably inclined, with the rear wall of the guide element 18 being inclined in a correspondingly complimentary manner. The head part 40 is preferably designed to be completely symmetrical on the upper face and lower face.

Figure 2:
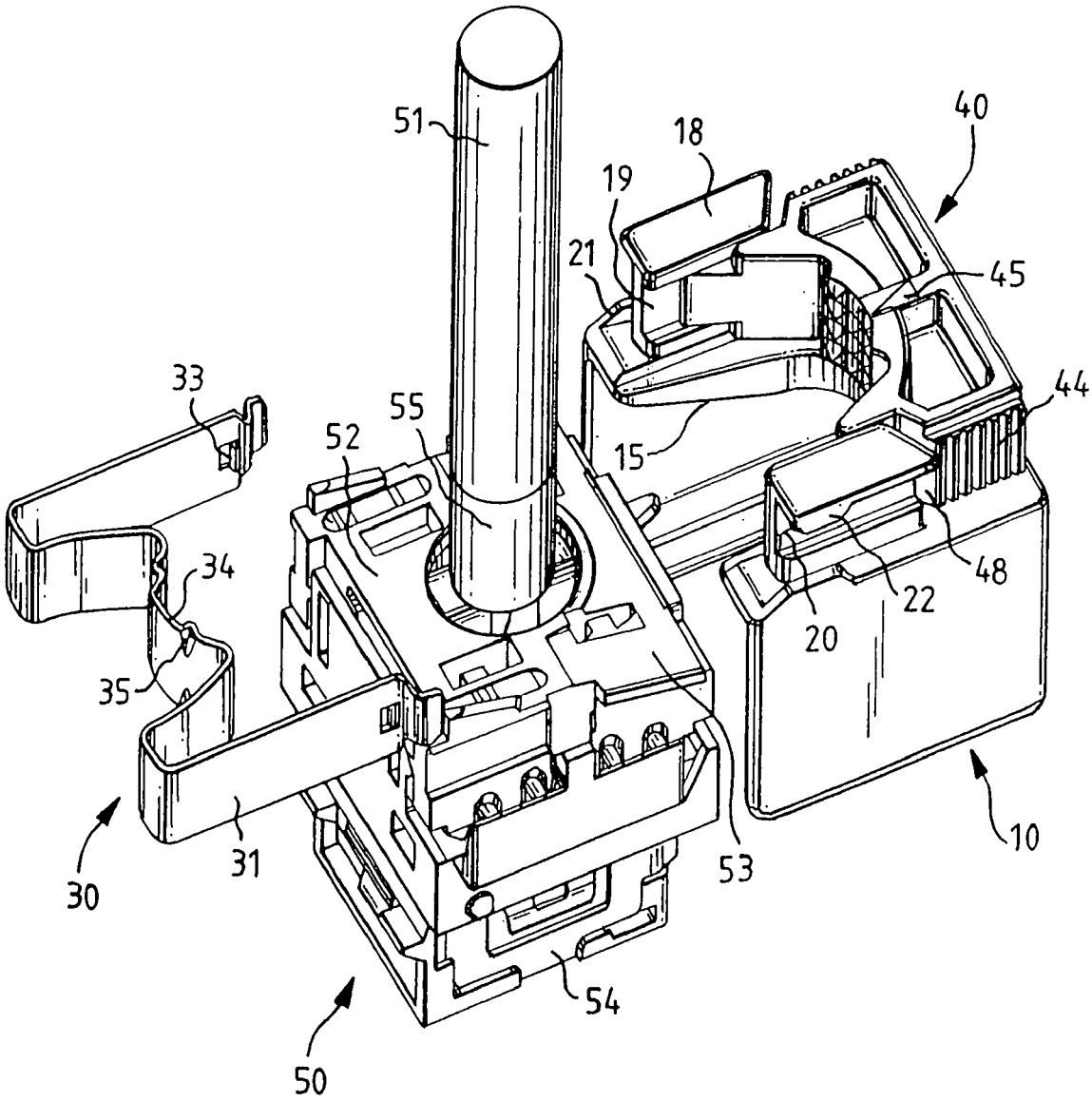
FIG. 2 shows a perspective exploded illustration of the strain relief device with a female connector body and a cable to be connected.

FIG. 2 shows the strain relief device 1 with a female connector housing 50 and a cable 51. The female connector housing 50 has, on its upper face, a cable manager 52 with inclines 53, which are designed to be complimentary to the guide edges 15 on the base part 10. The cable manager 52 has the function of guiding and positioning the conductors of the cable 51 in a defined manner. For this purpose, the conductors are routed from the upper face of the cable manager 52 through an opening, and are firmly clamped in a defined manner on the lower face, which cannot be seen, of the cable manager 52. The cable manager 52 is then placed on the female connector housing 50 with the conductors, positioned on the lower face, then being located above associated insulation-displacement terminal contacts, but not yet being pressed into them. This situation is illustrated in FIG. 2. The insulation-displacement terminal contacts are arranged in the interior of the female connector housing, and thus cannot be seen in FIG. 2. In a first preparatory step, the head part 40 is first of all pushed onto the base part 10. In the process, the latching tab (which is arranged on the lower face of the head part 40, cannot be seen in the illustration but is identical to the latching tab 45 which can be seen on the upper face) runs along the incline 16 and then slides into the depression 17. In the process, the rear wall of the depression 17 forms a stop for the head part 40, so that they are connected to one another in a captive manner. The forward movement of the head part 40 is limited by the guide element 18, since the head part 40 with the guide edges 41 can be moved only along the guide 19. Once the guide edges 41 have been completely inserted, then the stop surface 48 abuts against the rear face 24 of the guide element 18. The head part 40 is thus connected to the base part 10 such that it can move in a restricted manner. The range of movement is in this case preferably restricted to half of the cable diameter variation, as will be explained in more detail later.

In a next step, the base part 10 is pushed with the connected head part 40 onto the female connector housing 50 along the guide edges 14 and 15. Owing to the incline on the guide edge 15, the cable manager 52 is in the process pressed downward in the direction of the rest of the female connector housing 50. The conductors, which are positioned in the cable manager 52, are thus pressed into the insulation-displacement terminal contents. The guide edge 15 in this case acts like a drive, converting a sliding movement into a vertical movement. This makes it possible for the necessary contact-making force to be distributed more uniformly, so that contact can be made with the conductors, without any further tool, by means of the base part 10.

Once the base part 10 has been pushed onto the female connector housing 50, the closure means 30 can be latched on. To do this, the limbs 31 are moved along the guide 20 until the latching hooks 33 latch in a rib 44 on the head part 40. The diameter of the cable 51 determines which of the ribs 44 the latching hooks 33 latch into. The limbs 31 of the sprung latched-on closure means 30 are, in this case supported on the support point 21 and on the angle 22. Any opposing force from the cable 51 results in compression of the internal spring regions, thus producing a spring force which acts outward on the outer limbs 31. Since the outer limbs 31 are fixed by the support point 21 and the angle 22, this spring force leads to the free ends of the limbs 31 moving in the direction of the base part 10. The latching hooks 33 are thus pressed more deeply into the ribs 44 and counteract the opposing force. This results in virtually unlimited strain relief for the cable 51.

Particularly in plug connectors with high data transmission rates, such as Category 5 or Category 6 plug connectors, the conductors and the contacts must be arranged in a precisely defined manner with respect to one another. In this case, it is also important for the cable to be aligned in a defined manner with respect to the cable manager 52. If the base part 10 were now rigidly connected to the head part 40, then the closure means 30 would need to be pushed on to a different extent for different cable diameters and would be the only means to compensate for the different diameters. However, this would mean that the cable 51 was bent to a different extent, which is undesirable, however, owing to the stringent requirements with regard to crosstalk. This is where the mobility of the head part 10 comes into play. In this case, a different cable diameter is compensated for equally by the head part 40 and by the closure means 30, so that the cable is always at right angles to the cable manager 52, irrespective of its diameter. For this purpose, the base part 10 together with the head part 40 and the closure means 30 are preferably pushed onto the female connector body 50 at the same time and uniformly. The strain relief device 1 thus allows cables 52 of different diameter to be secured such that they are centered. In this case, half of the additional cable diameter is compensated for by the movement of the head part 40, and the other half is compensated for by the closure means 30, whose latching hooks 33 latch into one of the front ribs 44.

Furthermore, the strain relief device 1 can also be used to make contact with the shield. For this purpose, the base part 10 and the head part 40 are preferably in the form of zinc die-cast parts, which are thus electrically connected to one another. Depending on whether the shield 55 is a foil or a wire mesh, the shield 55 is bent upward over the insulation of the cable 51 while parts are being fitted to the cable manager 52. When the strain relief device 1 is being fitted to the female connector body 50 and to the cable 51, the head part 40 then makes contact with the shield 55 via the pyramid-like structures 46, and the closure means 30 make contact with the shield 55 via the concave indentation 34 and the projecting beads 35. At the same time, the base part 10 makes contact with the ground plate 54 in the female connector body 50, so that the shield 55 can then be connected to ground via the ground plate 54.

Figure 3:
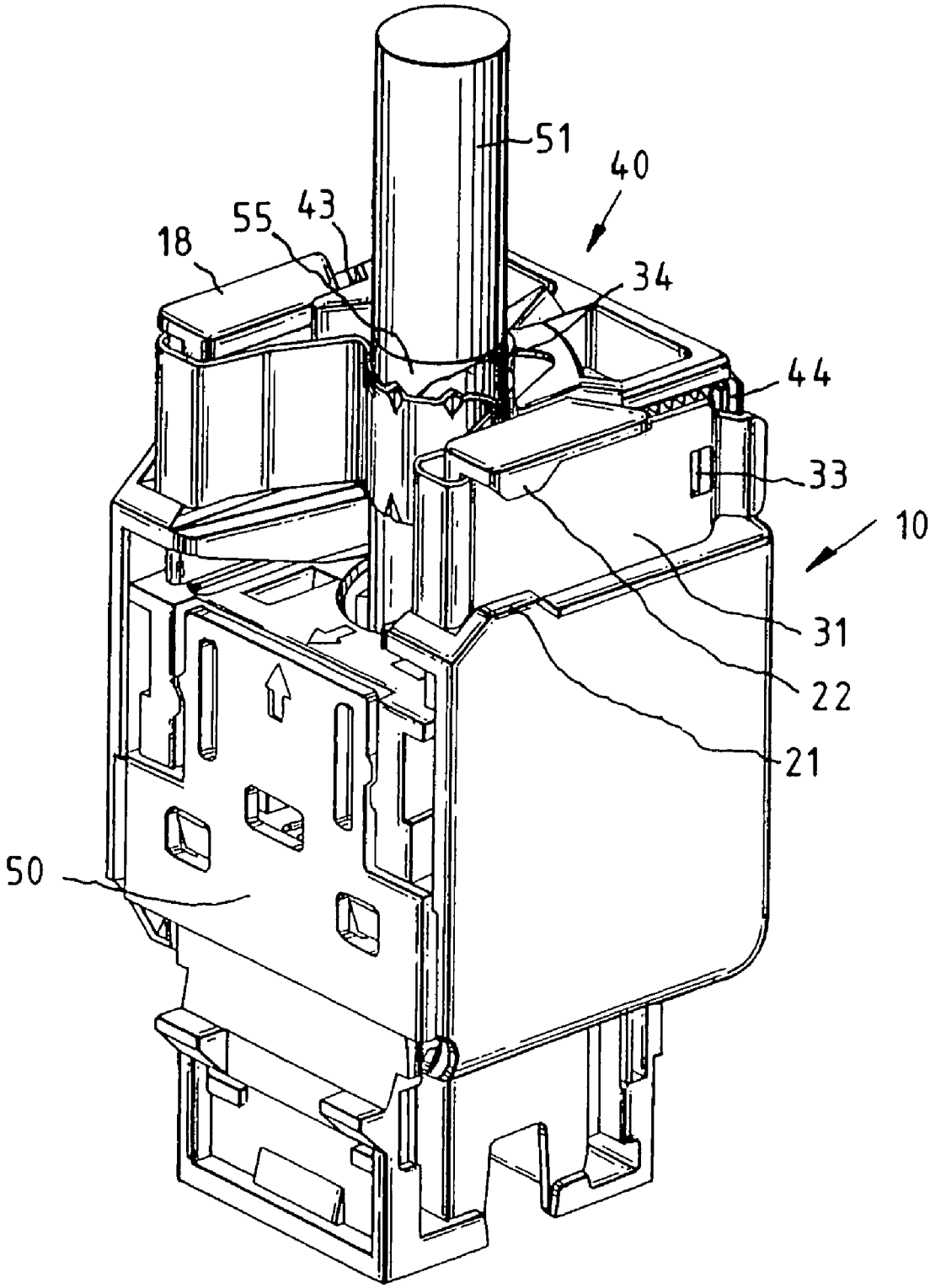
FIG. 3 shows a perspective illustration in the assembled state.

FIG. 3 shows the completely assembled strain relief device. As can be seen, the cable 51 is clamped in the region of the bent-up shield 55 by the concave region 34 of the W-shaped spring and by the structures of the head part 40, with the latching hooks 33 being latched into the ribs 44 on the head part 40. As can also be seen, the guide surface 43 of the head part 40 rests on the upper edge of the guide element 18. The free limbs 31 of the W-shaped spring are supported by the support point 21 and by the angle 22 on the front part of the base part 10.

What is claimed is:

1. A strain relief device for a communications cable, comprising:

a communications connector for the communications cable, the communications connector including a housing at which the communications cable can be terminated, the housing defining an opening through which the communications cable can extend out from the communications connector;

a base member, the base member including a body defining a hollow interior configured to receive the housing of the communications connector, the base member also defining a groove through which the communications cable can extend;

a latching member, the latching member configured to mount to the base member adjacent the groove, the latching member including first and second limbs extending from a central region, the latching member being substantially rigid; and a closure member, the closure member configured to mount to the base member adjacent the groove, the closure member including first and second limbs extending from a support element, the support element being configured to cooperate with the central region of the latching member to arrest the communications cable adjacent the groove in the base member, the first and second limbs of the closure member being substantially flexible and being configured to couple to the first and second limbs of the latching member.

2. The strain relief device of claim 1, wherein the latching member is mounted to the base member to enable restricted movement of the latching member along the base member.

3. The strain relief device of claim 1, wherein the first and second limbs of the closure member are configured to apply an inward compression force to the first and second limbs of the latching member in response to a force applied to the support element of the closure member by the communications cable.

4. The strain relief device of claim 1, wherein the closure member is generally W-shaped.

5. The strain relief device of claim 1, wherein the support element of the closure member defines a concave surface.

6. The strain relief device of claim 1, wherein the central region of the latching member defines a concave surface.

7. The strain relief device of claim 6, wherein the concave surface of the latching member defines a plurality of inwardly protruding pyramids.

8. The strain relief device of claim 1, wherein each of the first and second limbs of the latching member defines a plurality of ribs; and wherein each of the first and second limbs of the closure member includes a latching hook for latching to one of the ribs.

9. The strain relief device of claim 8, wherein the latching hooks of the closure member are configured to slide freely along the ribs of the latching member in a first direction.

10. The strain relief device of claim 1, wherein the base member is die-cast.

11. The strain relief device of claim 1, wherein the latching member is die-cast.

12. The strain relief device of claim 1, wherein the base member defines an inwardly inclined surface and an adjacent depression; and wherein the latching member defines an outwardly inclined surface configured to slide along the inwardly inclined surface of the base member and into the depression.

13. The strain relief device of claim 1, wherein the base member includes a pair of guide elements, each guide element including an inner guide and an outer guide.

14. The strain relief device of claim 13, wherein the inner guides are configured to receive the first and second limbs of the latching member and wherein the outer guides are configured to receive the first and second limbs of the closure member.

15. The strain relief device of claim 13, wherein the latching member defines a stop surface configured to abut against one of the guide elements of the base member.

16. The strain relief device of claim 15, wherein the stop surface is inclined.

17. The strain relief device of claim 1, wherein the base member defines an inclined guide edge along which the connector housing of the communications cable slides into the hollow interior of the base member.

18. The strain relief device of claim 1, wherein the communications connector comprises a cable manager.

19. The strain relief device of claim 1, wherein the communications connector comprises a female communications connector.

20. The strain relief device of claim 1, further comprising a shield arrested between the support element of the closure member and the central region of the latching element.

* * * * *